United States Patent [19]

Follett

[11] 4,066,798

[45] Jan. 3, 1978

[54] PROCESS FOR VACUUM PACKING AND COOLING MEAT CUTS

[75] Inventor: Michael John Follett, Fleet, England

[73] Assignee: J. Sainsburg Limited, London, England

[21] Appl. No.: 722,287

[22] Filed: Sept. 10, 1976

Related U.S. Application Data

[63] Continuation-in-part of Ser. No. 476,609, June 5, 1974, abandoned.

[30] Foreign Application Priority Data

June 25, 1973 United Kingdom ..... 30063/73

[51] Int. Cl.[2] ..... B65B 25/00

[52] U.S. Cl. ..... 426/393; 426/410; 426/414; 426/418

[58] Field of Search ..... 426/129, 393, 410, 418, 426/518, 524, 412, 413, 415, 414

[56] References Cited

U.S. PATENT DOCUMENTS

| | | | |
|---|---|---|---|
| 2,519,931 | 8/1950 | Roschen et al. | 426/418 |
| 2,806,792 | 9/1957 | Cameron | 426/418 |
| 2,904,316 | 9/1959 | Hagen et al. | 426/524 |
| 2,988,452 | 6/1961 | Cameron | 426/55 |
| 3,359,122 | 12/1967 | Lebarth et al. | 426/393 |
| 3,607,312 | 9/1971 | Ready | 426/393 |
| 3,634,127 | 1/1972 | Vogel et al. | 426/393 X |
| 3,637,405 | 1/1972 | Mendelson | 426/2 |
| 3,705,813 | 12/1972 | Vogel et al. | 426/2 |
| 3,713,847 | 1/1973 | Vogel et al. | 426/393 |
| 3,813,467 | 5/1974 | Drain | 426/393 |

OTHER PUBLICATIONS

Cry-o-vac, Bulletin L.I, 1940, pp. 1-6.

*Primary Examiner*—Steven L. Weinstein
*Attorney, Agent, or Firm*—Karl W. Flocks

[57] ABSTRACT

Raw red meat is excised from a carcass within ½ to 8 hours after the animal's death and vacuum packed in synthetic, air impermeable plastic bags which are then placed in a cooling environment which has a temperature maintained at 23° F to 60° F for a sufficient length of time for the meat to fall to a temperature in this range, the rate of cooling of the muscle being such that a substantially consistent rate of temperature fall is achieved throughout the muscle. After cooling the packed meat can be stored at 28.5° F to 45° F, without freezing, for up to 6 weeks.

10 Claims, No Drawings

PROCESS FOR VACUUM PACKING AND COOLING MEAT CUTS

CROSS REFERENCE TO RELATED APPLICATIONS

This application is a continuation-in-part of co-pending Application Ser. No. 476,609, filed June 5th 1974, and now abandoned in favor of the present application.

BACKGROUND OF THE INVENTION

1. Field of the Invention

This invention relates to a process for the treatment of raw red meat primarily that is to say, beef, lamb, veal and venison.

2. Description of the Prior Art

Within the last decade the handling and distribution of raw red meat from source of supply i.e., abattoires to wholesale or retail outlets has undergone major changes. One of these changes is the breakdown of beef quarters into de-boned primal cuts within 1½ to 3 days of slaughter of the animal, vacuum packing the cuts into synthetic plastic bags and sealing them by a clip or a heat seal. These vacuum packed beef cuts can be stored for up to 6 weeks in favourable conditions before the meat is deemed unfit for human consumption. There are two methods of vacuum packing meat in synthetic plastics bags namely the Grace system and the chamber system.

The Grace system is carried out by subjecting the bag interiors to a vacuum i.e., reduced pressure after which the bags are sealed by any suitable means such as by the application of clips round the bag neck or by heat sealing the openings of the bag. In this system some air can enter the bags after removal of the evacuating device. The chamber system is carried out in a sealed vacuum chamber which is capable of being subjected to reduced pressure; in the chamber the bags previously filled with the meat, are sealed, and then the chamber is returned to atmospheric pressure by the admission of air so that the material of the bag is drawn into contact with the meat.

Drawbacks of vacuum packed de-boned primal cuts of beef — drip and discolouration can lead to gross economic losses and difficulties in handling. As much as 7% of the weight of a vacuum packed cut of beef can be present as loose beef after 7 days chill storage.

Another drawback of de-boned primal cuts lies in the phenomenon known as shortening. When a carcass enters the stage of rigor mortis there is a change in the stretch characteristics of the muscle. Very often the muscle undergoes shortening, and the degree of shortening or contraction affects the ultimate tenderness of the meat, such that muscles which are fully or in a partially contracted state produce meat which is less tender than that from muscles which have not contracted. The rate of cooling which affects the rate of onset of rigor mortis in turn influences the tenderness of the meat. The faster the rate of cooling the more chance the meat will be tough because of cold contraction or cold shortening.

Where the muscle has been excised before cooling there is a greater risk of this phenomenon occurring since the muscle is detached from the skeleton and therefore possesses no anchor points to enable it to resist shortening. Conventionally abattoires cool rapidly to lower the temperature in the deep musculature of the buttock region, which is successful for the deeper muscle but causes permanent toughening due to cold shortening in the thinner regions of the carcass. With pre-rigor excised muscles the toughening effect is enhanced for the reasons explained above.

The main object of the present invention is to provide a process by which disadvantages such as staining due to drip loss, drip loss and trimming losses are reduced or minimised, evaporation losses in the initial 48 hours after killing are eliminated, and qualities of meat such as colour before cooking and tenderness and flavour of the cuts after cooking are enhanced.

SUMMARY

According to the present invention a process for packing raw red meat into domestic cuts comprises removing at least part of one of the muscles of a carcass of raw red meat within ½ to 8 hours of the animal's death and forming domestic cuts thereof, vacuum packing said cuts in air impermeable plastic bags, cooling said sealed bags in a coolant having a temperature of 23° F to 60° F for a sufficient length of time for the meat to fall to a temperature within this range, the rate of cooling of the muscle being such that a substantially consistent rate of temperature fall is achieved throughout the muscle, and storing said bags at 28.5° F to 45° F and for a period of up to 6 weeks.

In carrying out the procedure of the invention a vacuum packed cut of meat is placed in a chamber equipped for maintaining the environment, e.g. air, therein at an approximately constant temperature and the pack will thereupon lose heat to the surrounding environment. Forced cooling is not necessary and indeed may be positively harmful since it could create large temperature gradients in the meat.

A vacuum packed cut of beef at substantially body temperature can therefore be placed in such a chamber with an atmosphere e.g. of air at 23° F or any other temperature in the range 23° F to 60° F and allowed to fall to a temperature in the range 23° F to 60° F. Thus with an environment maintained at 23° F the meat need only be cooled to e.g. 45° F, or with an environment at 50° F the meat may be allowed to cool to this temperature.

Heat lost to the environment can be removed by a refrigeration system, e.g., by passage of the coolant through an external heat exchanger so that some circulation of coolant may thus be necessary.

It is possible to treat in this way cuts of meat in the form they are generally removed from the bone. If desired, however, for smaller cuts a number thereof may be packed together in say 20*lb* blocks and subjected to the cooling treatment in this form.

It has been found that generally the meat, including the 20*lb* blocks mentioned above, will reach the set ambient temperature of the range 23° F to 60° F within 24 hours, but if desired the meat can advantageously be kept in the said environment for up to 72 hours.

After cooling and, if desired, holding the packed meat may be transferred to a storage station. The storage station is maintained at 28.5° F to 45° F, and is conveniently but not essentially at the temperature of the cooled meat transferred thereto. The length of time of storage can vary widely and is dependent upon commercial factors, for example the cost of holding stocks of unsold meat and the variation in the market price of raw meat. The meat can be satisfactorily stored for up to 6 weeks. If desired, however, the meat can be sold directly after cooling.

After cooling and after the rigor stage, storage of the meat, for up to 6 weeks enables the meat to mature. This maturation causes tenderising and much of the toughness incurred during rigor mortis is resolved, although it should be noted that such maturation will not resolve the toughness produced by cold contraction which can occur if cooling is carried out at rates higher than is compatible with the operating conditions of the present invention. Maturation is generally accepted to be the loss of tensions developed in the muscles during rigor mortis by the systematic degradation of certain structural proteins by enzymes released from organelles within the meat tissue. Although meat produced by the invention is usually suitable for consumption immediately after cooling, a period in storage to allow maturation to proceed will result in increased tenderness and flavour.

As explained above the cooling of the meat is carried out by using an environment whose temperature is maintained in the range 23° F to 60° F and the temperature of the meat is allowed to fall to a temperature within that range. The cooling period is, thus determined by the temperature attainment of the meat and may be for instance 24 hours or shorter depending on the final desired temperature. For example, a vacuum packed cut is cooled in water at a temperature from 32° F to 60° F for a period of at least 10 hours and is thereafter stored for a period of up to 144 hours or a vacuum packed cut is cooled in air at a temperature from 28.5° F to 45° F for a period of at least 24 hours and is thereafter stored for a period of up to 5 weeks.

It will be appreciated that before being placed in the cooling environment the meat will have already undergone some cooling, and that a temperature gradient will have been established in the meat. This may for example be as high as 10° or 11° F for topside or rump muscles.

By cooling the de-boned meat according to the process of the invention the temperature gradient within the meat is quickly reduced, substantially disappearing after 12 hours and generally being eliminated after 24 hours.

Where the temperature of the cooling environment is relatively low, for example in the region of 40° F or lower, a temporary small rise in the temperature gradient may be experienced e.g. of about 1° or 2° F.

In carrying out the same procedure on an intact side of the same meat a considerable and prolonged increase in the temperature gradient within the meat can be observed e.g. up to 33° F, and after 24 hours cooling a temperature gradient e.g. of about 10° F will still exist, particularly in the thicker cuts such as topside and top rump.

The cooling of the de-boned meat is thus carried out in a controlled manner, cooling rates of for example 0.06° to 0.12° F per minute or even less being utilised during the first 24 hours. Such cooling rates avoid cold shortening and all its inherent dangers to the ultimate meat quality.

For purposes of comparison the following Table is given to show the deep (8 cm) and shallow (2 cm) temperatures recorded in excised topside and top rump treated in accordance with Examples 1 and 2, and corresponding muscles intact in the carcass cooled in an environment maintained at the indicated temperatures.

| TREATMENT | | | HOURS POST MORTEM 1 | 6 | 12 | 18 | 24 |
|---|---|---|---|---|---|---|---|
| Excised topside and top rump muscles cooled at 50° F | Deep | °F | 102 | 72 | 57 | 53 | 50 |
| | Shallow | °F | 91 | 62 | 54 | 52 | 50 |
| | Difference | °F | 11 | 10 | 3 | 1 | 0 |
| Excised topside muscles cooled at 41° F | Deep | °F | 102 | 68 | 50 | 45 | 41 |
| | Shallow | °F | 92 | 57 | 47 | 44 | 41 |
| | Difference | °F | 10 | 11 | 3 | 1 | 0 |
| Topside/top rump cooled in the intact side at 32° F | Deep | °F | 108 | 91 | 70 | 55 | 49 |
| | Shallow | °F | 93 | 58 | 47 | 40 | 40 |
| | Difference | °F | 15 | 33 | 23 | 15 | 9 |

The results clearly show how in the excised muscle the temperature gradient within the meat is relatively quickly reduced, whereas in the case of the muscle cooled in the intact side a considerable increase in the temperature gradient is experienced and after an equivalent period a significant temperature gradient is still present.

Preferably the muscles such as beef muscles, e.g. the semi-tendinosus muscle (silverside), semimembranosus muscle (part of the topside) are removed complete from the carcass of the animal. However, the muscles may be partially removed by the butcher's cut method of cutting quarters of the carcass into primal cuts where the cuts are made often across muscles.

Suitable bags for sealing the wholesale or retail cuts which are formed by cutting up the muscles removed from the carcass, are formed of sheet material usually nylon -polyethylene laminate material. However, any container may be used which is water and gas impermeable and is capable of withstanding reduced pressure and higher pressures within the packing chamber.

The invention will now be further described with reference to the following Examples in which the meat was beef.

DESCRIPTION OF THE PREFERRED EMBODIMENTS

EXAMPLE 1

The topside cuts (semimembranosus and gracilis muscles) were removed from the beef carcass at 1 hour post mortem, (i.e., the animal's death), and immediately vacuum packed in nylon-polyethylene laminated bags by the chamber process. The bagged meat was cooled and stored in air at 50° F for 24 hours and then stored at 30° F (non-freezing) to about 34° F for a further 14 days.

EXAMPLE 2

Topside cuts from beef hindquarters were removed from the carcass 1 hour after slaughter of the animal and vacuum packed in nylon-polyethylene laminated bags by the chamber process. The vacuum packs of meat were then cooled and stored in air at 41° F for 72 hours and subsequently stored at 30° F (non-freezing) to about 34° F for a further 4 days.

EXAMPLE 3

The top rumps were removed from the beef carcasses at 1 hour after slaughter of the animal, vacuum packed in a nylon-polyethylene laminated bag and subsequently cooled and stored at 50° F for 24 hours. The vacuum packs were then stored in air at 30° F (non-freezing) to about 34° F for a further 6 days.

The properties of the packs of meat prepared as in the above Examples at 7 days post slaughter were compared with meat prepared by a process in which muscles are left in the intact carcass for 36 hours then excised and immediately vacuum packed in nylon-polyethylene laminated bags and stored for 5 days at 32° F (non-freezing) to about 34° F. In the meat prepared according to the invention dehydration losses within the initial 35 hours were substantially eliminated; a far more consistent colour was observed throughout each of the cuts prepared according to the invention and loose drip in the vacuum packs was appreciably reduced e.g. by about 60 to 90%.

Internal bacterial counts of the meat were not markedly affected by the process of the invention, meat tenderness was not adversely affected in the packet cuts pre-packed for the retail market and on many occasions testing established that tenderness was in fact enhanced by the process. The trimming losses compared with ordinary retail butchery trimming losses were markedly reduced.

Fat staining by the loose drip in the vacuum pack was much lower than with conventional processes and was sufficiently low as to be unimportant. Loose drip from the retail prepared commodities was not adversely affected and was on occasions marginally reduced compared with that from cuts prepared by the known processes.

I claim:

1. A process for packing raw red meat into domestic cuts comprising removing at least part of one of the muscles of a carcass of raw red meat within ½ to 8 hours of the animal's death and forming domestic cuts thereof, vacuum packing said cuts in air impermeable plastics bags, cooling under controlled conditions said sealed bags in a coolant having a temperature of 23° F and 60° F for a sufficient length of time for the meat to fall to a temperature within this range and for a minimum of 10 hours in water or about 24 hours in air, the rate of cooling of the muscle being sufficiently slow so that the temperature gradient within the meat is relatively quickly reduced such that a substantially consistent rate of temperature fall is achieved throughout the muscle, and storing said bags at 28.5° F to 45° F and for a period of up to 6 weeks.

2. A process according to claim 1, in which muscle is removed from the carcass within ½ to 5 hours of the animals death.

3. A process according to claim 1, wherein the vacuum packed cuts are held in the cooling environment for a period of 24 hours to 72 hours.

4. A process according to claim 1, wherein said muscle meat removed from said carcass is within the group consisting of semitendinosus (silverside) semimembranosus (topside), vastus (top rump) and gracilis (part of the topside) muscles.

5. A process according to claim 1, wherein said muscle meat of said cuts is at least partially removed from said carcass by the butcher's cut method.

6. A process according to claim 1, wherein said bags are of nylon-polyethylene laminate which is air and water impermeable and capable of withstanding reduced and elevated pressures within said sealed bags.

7. A process according to claim 1, wherein a vacuum packed cut is cooled in water at a temperature from 32° F to 60° F for a period of at least 10 hours and is thereafter stored for a period of up to 144 hours.

8. A process according to claim 7, wherein said vacuum packed cuts are cooled in water at a temperature from 40° F to 50° F.

9. A process according to claim 1, wherein a vacuum packed cut is cooled in air at a temperature from 28.5° F to 45° F for a period of at least 24 hours and is thereafter stored for a period of up to 5 weeks.

10. A process in accordance with claim 1 wherein said cooling under controlled conditions in a coolant having a temperature of 23° F to 60° F is carried out at a rate of about 0.06° to about 0.12° F per minute.

* * * * *